United States Patent [19]

Foa

[11] 4,239,155

[45] Dec. 16, 1980

[54] CORE-FLOW ROTARY JET

[75] Inventor: Joseph V. Foa, Chevy Chase, Md.

[73] Assignee: The United States of America as represented by the Secretary of the Navy, Washington, D.C.

[21] Appl. No.: 43,927

[22] Filed: May 30, 1979

[51] Int. Cl.[3] ..... B63H 25/46

[52] U.S. Cl. ..... 239/265.17; 60/271; 417/187

[58] Field of Search ..... 239/265.11, 265.17, 239/265.19; 417/180, 187, 189, 194, 198, 162, 166; 60/271

[56] References Cited

U.S. PATENT DOCUMENTS

| | | | |
|---|---|---|---|
| 3,046,732 | 7/1962 | Foa | 60/35.6 |
| 3,374,631 | 3/1968 | Marks | 60/244 |
| 3,420,060 | 1/1969 | Ostroff et al. | 417/187 X |
| 3,447,324 | 6/1969 | French | 60/221 |
| 3,575,127 | 4/1971 | Wislicanus | 115/12 |
| 3,710,890 | 1/1973 | True | 239/265.11 |
| 3,783,814 | 1/1974 | Zovko | 60/271 X |
| 3,830,431 | 8/1974 | Schwartz | 239/265.11 |

FOREIGN PATENT DOCUMENTS

| | | | |
|---|---|---|---|
| 570334 | 2/1959 | Canada | 239/265.17 |

OTHER PUBLICATIONS

Foa, J. V., "A New Method of Energy Exchange Between Flows, and Some of its Applications;" RPI Technical Report.

Foa, J. V., "Cryptosteady Energy Exchange," RPI Technical Report, TR-AE 6282, Mar. 1962.

Foa, J. V., "A Method of Energy Exchange," American Rocket Society Journal, vol. 32, #9 9/1962.

Foa, J. V., "A Vaneless Turbopump," AIAA Journal, vol. 1, No. 2, 2/1963.

*Primary Examiner*—Robert B. Reeves

*Assistant Examiner*—Gene A. Church

*Attorney, Agent, or Firm*—R. S. Sciascia; Sol Sheinbein

[57] ABSTRACT

A rotary jet including a core-flow arrangement minimizes flow separation of primary and induced secondary flows over the afterbody of the jet rotor. By discharging a small portion of the primary jet through a central opening in the afterbody concentric with the nozzled rotor, a favorable pressure gradient is generated over the surface of the afterbody, which helps reduce or prevent flow separation thereover.

19 Claims, 2 Drawing Figures

CORE-FLOW ROTARY JET

BACKGROUND OF THE INVENTION

This invention relates to thrust augmenters, and more particularly to rotary jet ejectors incorporating a core flow arrangement.

U.S. Pat. No. 3,046,732 to Foa, incorporated herein by reference, discloses a method and apparatus for effecting a highly efficient direct energy transfer between a primary or driving fluid and a secondary fluid. One arrangement set forth, the axial flow rotary jet, contemplates a rotor carrying nozzles oriented so that they are skewed relative to the axis of the rotor and communicating with a source of primary fluid under pressure. The region occupied by the driving fluid emerging from the rotor rotates about the same axis and at the same angular velocity as the rotor. The boundaries of this region are interfaces separating the driving fluid from the driven fluid with the relation of the interfaces to the induced flow pattern dynamically substantially like that of blade or vane surfaces of the same shape rotating at the same angular velocity. Thus the driving fluid forms "pseudo-blades", the action of which on the driven fluid is somewhat similar to the flow induction process of solid vanes or blades in dynamic flow machines. Where the stream issuing from the rotating orifice has an axial component such that its axis in its rotation describes a hyperboloid which is nearly a cylindrical surface, and the interaction space is shrouded, substantial thrust augmentation is typically produced by the resultant induced secondary fluid flow.

One of the main obstacles to the attainment of the maximum potential performance of axial-flow, rotary jet energy exchange mechanisms, of the kind disclosed in U.S. Pat. No. 3,046,732, has been found to be the occurrence of fluid flow separation over the trailing surface of the rotor casing (also known as the afterbody) where the pressure increases in the direction of the flow of fluid. Flow separation results in not only an increase of the pressure drag, but also a recirculation of flow of secondary fluid induced by the primary jet flow. This latter result is particularly undesirable inasmuch as it produces a loss of pumping effectiveness of the "pseudo-blades". Well known methods exist for retarding or preventing flow separation in regions of adverse pressure gradient, e.g., boundary layer suction or injection, "vortex generators", and others, but all such methods entail either flow losses or mechanical complications, or both.

SUMMARY OF THE INVENTION

Accordingly, the present invention provides for a rotary jet thrust augmenter which diverts a portion of the primary flow from the path through the rotor nozzles and discharges that portion through a central passage. Pressurized primary fluid is carried, via a supply duct, from a source to nozzles circumferentially spaced about a rotor rotatably supported on a fixed shell. The shell is concentrically disposed within the rotor, and includes a truncated substantially conical afterbody attached rearwardly thereof, and a central passage therethrough communicating the supply duct with an interaction space within a shroud. The primary fluid emanating from the rotating nozzles generates a helical flow pattern over the afterbody and through the shroud. This primary fluid flow interacts with ambient secondary fluid and is induced into and through the shroud. The portion of the primary fluid diverted through the central passage emanates therefrom in the form of a central jet, and acts to entrain primary and secondary flows entering the shroud along the outer surface of the afterbody.

OBJECTS OF THE INVENTION

It is therefore an object of this invention to minimize flow separation in rotary jet thrust augmenters to thereby maximize the transfer of energy from one flowing fluid to another fluid.

Another object of the present invention to improve performance from an axial flow rotary jet thrust augmenter by reducing flow separation over the surface of the afterbody.

Another object of the invention is to retard or prevent flow separation over the surface of the afterbody by substituting a centrally disposed fluid jet for a portion of the separation region of the afterbody.

Yet another object is to increase thrust augmentation in a rotary jet ejector through the injection of air or other fluid into the central stream.

Still another object is to maintain a favorable pressure gradient over the afterbody through entrainment of primary and secondary flows along the afterbody outer surface.

BRIEF DESCRIPTION OF THE DRAWINGS

Other objects and many of the attendant advantages of this invention will readily be appreciated as the same becomes understood by reference to the following detailed description when considered in connection with the accompanying drawings in which like reference numerals designate like parts throughout the figures thereof and wherein.

DETAILED DESCRIPTION OF THE INVENTION

Figure 1:
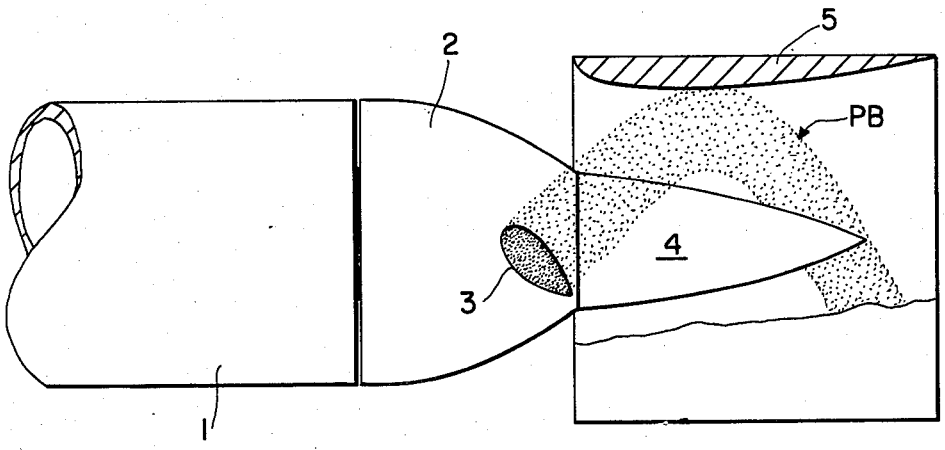
PRIOR ART FIG. 1
FIG. 1 depicts the prior art rotary jet disclosed by U.S. Pat. No. 3,046,732.

Referring now to the drawings wherein like characters and reference numerals designate like or corresponding parts throughout the several views, there is shown in FIG. 1 a thrust augmenting rotary jet substantially as disclosed in U.S. Pat. No. 3,046,732 wherein supply duct 1 carries primary or driving fluid under pressure from a source into rotor 2 where the fluid exits through circumferentially spaced nozzles 3, although only one is shown in the Figure. As the primary fluid exits, rotor 2, as a result of nozzles 3 being skewed relative to the axis of rotation of the rotor, is maintained in a state of rotation. The issuing primary fluid, as a result of the rotor rotation, forms helical pseudo-blades PB which rotate at the same angular velocity as nozzles 3 helically about, and axially along, afterbody 4. By such action of the pseudo-blades, a low pressure region is created at the leading (leftmost in FIG. 1) edge of shroud 5, and axial flow of the surrounding secondary fluid is induced into and through the shroud.

Figure 2:
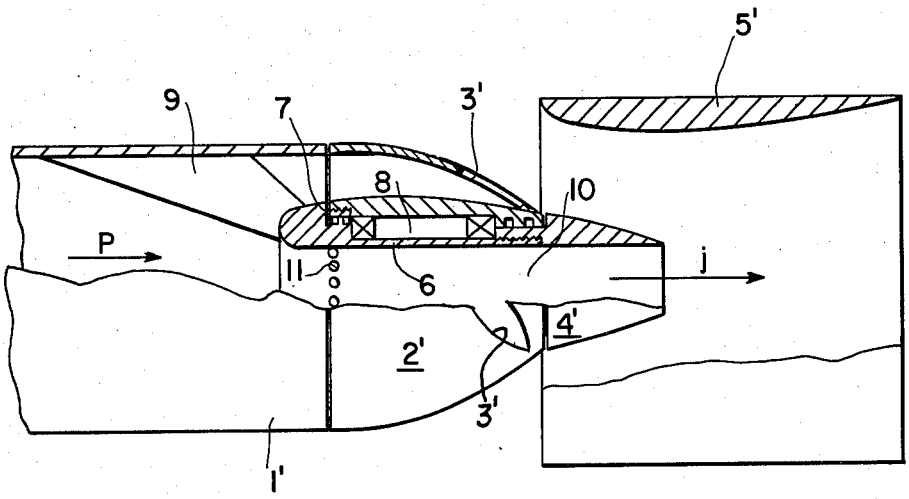
FIG. 2 illustrates a preferred embodiment of the rotary-jet of the present invention.

FIG. 2 illustrates the modified rotary jet of the present invention in which supply duct 1' carries primary or driving fluid P under pressure from a source into the rotatable rotor 2' where a major portion of the primary fluid exits through circumferentially spaced, skewed nozzles 3' on rotor 2'. In this way, as the fluid exits from the nozzle the rotor is maintained in a state of rotation. And as a result of this rotor rotation, the issuing primary fluid forms helical pseudo-blades in the same manner as set forth for the rotary jet of FIG. 1. Stationary, non-rotating support shell 7 is firmly held in concentric alignment with supply duct 1' by radially arranged streamlined arms 9 or other suitable means. Rotor 2' is rotatably supported about shell 7 through bearing assembly 8. Bearing assembly 8 is disposed in a circumferential recess 6 in the outer surface of the shell. Passage 10, associated with, and disposed concentrically within shell 7, extends longitudinally through both shell 7 and afterbody 4', the latter having the shape of a truncated cone with the larger diameter end being attached to the shell behind bearing assembly 8 just forwardly of the leading edge of shroud 5', central passage 10 communicating the interaction space within shroud 5' at the smaller diameter. Other variations are possible, e.g. afterbody 4' can also be unitary, and therefore rotatable with, the rotor. Central passage 10 permits a small portion of primary fluid P to bypass rotor nozzles 3' and be discharged instead in the form of central jet j.

The percentage of primary flow that is diverted from rotor nozzles 3' to central passage 10 may be controlled in a number of ways, e.g. through the use of nozzles, valves, variable-geometry arrangements, etc. A particularly effective control method, which is possible in some cases, is accomplished through the injection of fluid, e.g. compressed air, into the central stream through wall openings or orifices 11, as shown in FIG. 2. The fluid being injected is supplied from a source external to shell 7 and is interconnected with that source by tubes or pipes (not shown) which are carried internally of arms 9. Orifices 11 may be disposed forwardly of afterbody 4', preferably adjacent the forward or leading portion of rotor 2', and rearwardly of the leading edge of shell 7. Where the primary fluid is water and the injected fluid is air, the resulting central jet will be an air-augmented water jet, which will contribute to the overall thrust augmentation of the rotary jet. Very simply, the compressed air expands and causes an increase in the velocity of the water-and-air mixture through the shell central passage thereby resulting in thrust augmentation. A more complete discussion of this phenomenon is found in "Thrust of an Air-Augmented Waterjet", by R. G. Amos, G. Maples & D. G. Dyer, Journal of Hydronautics, Volume 7, April 1973, pages 64–71.

There has therefore been described an axial flow rotary jet thrust augmenter having rotating nozzles driven by pressurized primary fluid flow and a central passage for diverting a portion of the primary flow therethrough so that performance is improved. The central passage produces a jet which overcomes the flow separation difficulties inherently present when using the rotary jets of U.S. Pat. No. 3,046,732, by not only eliminating the most critical aspects of the boundary layer control portion of the afterbody but also, through an entrainment effect, maintaining a favorable pressure gradient, or at least reducing the unfavorable pressure gradient, over the remaining portion of the afterbody.

What is claimed is:

1. A core-flow rotary jet comprising:

a source of pressurized first fluid, rotor means including at least one nozzle, a supply duct connected between said source of first fluid and said rotor means, a shrouded afterbody disposed behind, and coaxially with, the rotor such that said pressurized first fluid issuing from said at least one nozzle induces flow of ambient second fluid through said shroud, and means for diverting a portion of said first fluid from said rotor and through a centrally disposed passage in said afterbody, whereby fluid exiting from said central passage entrains said first and second fluids along the outer surface of said afterbody such that flow separation of said fluids along said afterbody surface is reduced.

2. The core-flow rotary jet as set forth in claim 1 wherein said diverting means includes means for injecting a third fluid into the flow of primary fluid through said passage in said afterbody.

3. The core-flow rotary jet as set forth in claim 1 wherein said diverting means includes means for controlling the amount of fluid diverted from said rotor to said afterbody centrally disposed passage.

4. The core-flow rotary jet as set forth in claim 1 wherein said diverting means includes arm means for supporting said diverting means within said supply duct such that said diverting means is disposed coaxially relative to said duct.

5. The core-flow rotary jet as set forth in claim 4 wherein said diverting means further includes means for injecting a third fluid into the flow of first fluid through said passage in said afterbody.

6. The core-flow rotary jet as set forth in claim 1 wherein said diverting means comprises a shell having a central opening therethrough, said shell having located thereon said supporting means, said supporting means having bearing means disposed about the outer periphery of said shell for rotatably supporting said rotor means.

7. The core-flow rotary jet as set forth in claim 6 wherein said shell is disposed forwardly of said afterbody and said opening in said shell is concentric with said centrally disposed passage in said afterbody.

8. The core-flow rotary jet as set forth in claim 6 wherein said arm means further comprises a plurality of circumferentially spaced arms interconnecting said shell with said supply duct.

9. The core-flow rotary jet as set forth in claim 8 wherein said diverting means further includes means for injecting a third fluid into said central opening of said shell, said arms carrying means for communicating said injecting means with a reservoir containing said third fluid.

10. The core-flow rotary jet as set forth in claim 9 wherein said first and second fluids are incompressible, said third fluid is compressible, and said injecting means comprises at least one orifice disposed in the central opening of said shell, such that upon its injection through said at least one orifice into said opening, said compressible fluid expands as it mixes with said diverted primary fluid thereby causing increased flow velocity through the opening and a resultant augmentation of thrust.

11. In combination with a thrust augmenting rotary jet of the kind including a nozzled rotor having an outer diameter from which a first portion of primary flow issues, an axially disposed shell on which said rotor is supported, and a shroud disposed behind, and coaxially with, the rotor wherein the first portion of primary flow issuing from the rotor induces a secondary flow of ambient fluid through the shroud, a boundary layer control apparatus comprising:

an afterbody including a hollow portion attached to said shell and disposed coaxially therewith, said afterbody being located downstream of said rotor, said shell including means for channelling a second portion of said primary flow from said rotor and through said hollow portion of said afterbody, whereby the second portion of said primary flow emanating from said hollow portion entrains the first portion of the primary flow and the secondary flow along the outer surface of the afterbody such that flow separation is minimized.

12. The combination as set forth in claim 11 wherein:

said channelling means comprises a passage in said axially disposed shell, said passage being aligned with said hollow portion of said afterbody.

13. The combination as set forth in claim 12 wherein:

said channelling means further comprises an edge on said axially disposed shell facing upstream, said edge being disposed upstream of said rotor.

14. The combination as set forth in claim 13 including:

means for controlling the amount of said second portion of primary flow, said controlling means being disposed forwardly of said afterbody hollow portion.

15. The core-flow rotary jet as set forth in claim 4 further including means for supporting said rotor means for allowing free rotation thereof such that said rotor means is disposed coaxially relative to said duct.

16. A fluid apparatus for generating fluid flow comprising:

means for generating a motive primary fluid flow;

rotor means for discharging a first portion of said primary fluid flow; said rotor means having an external surface and being freely rotatable about a central axis; said rotor means having nozzle means on said external surface for discharging said first portion of said primary fluid flow into an ambient secondary fluid in rotating fashion developing a substantially helical flow path for said first portion of said primary fluid flow such that said helical flow path combines with and induces the flow of said secondary fluid;

said rotor means further surrounding aperture means centrally located on said central axis of said rotor means for allowing a second portion of said primary fluid flow to pass therethrough;

said external surface on said rotor means being generally tapered inwardly from a first end where said primary fluid enters to a second end opposite the first end;

whereby said first portion of said primary fluid flow and said secondary fluid form a combined flow adjacent said tapered external surface of said rotor means and said second portion of said primary fluid flow mixes with said combined flow in the vicinity of said second end to alleviate flow separation.

17. The invention as defined in claim 16 including supply duct means for transmitting said primary fluid flow to said rotor means; shell means positioned centrally within said aperture means for transmitting said second portion of said primary fluid flow through said aperture means; said shell means being connected to said supply duct means by arm means which position said shell means substantially concentrically within said supply duct means; an afterbody located adjacent said second end of said rotor means, said afterbody having a central aperture in alignment with said aperture means for allowing continued flow of said second portion of said primary fluid flow; shroud means surrounding said afterbody in concentric fashion for augmenting the thrust of the combined flow; whereby the exiting of said second portion of said primary fluid flow through said central aperture in said afterbody entrains the combined flow along the outer surface of the afterbody to reduce flow separation thereby.

18. The invention as defined in claim 17 wherein said shell means has an external surface and bearing means are located on a portion of said external surface for facilitating rotation of said rotor means.

19. The invention as set forth in claim 18 wherein said shell means includes means for controlling the amount of said second portion of said primary fluid flow passing therethrough, said controlling means including openings in said shell means and means for passing compressed air therethrough.

* * * * *